US012467455B2

(12) United States Patent
Vanderlaan et al.

(10) Patent No.: US 12,467,455 B2
(45) Date of Patent: Nov. 11, 2025

(54) HYDRAULIC GEAR PUMP WITH HYDROSTATIC SHAFT BEARING AND ISOLATED CASE DRAIN AND METHOD OF OPERATING A HYDRAULIC GEAR PUMP

(71) Applicant: Parker-Hannifin Corporation, Cleveland, OH (US)

(72) Inventors: Dale E. Vanderlaan, Charlotte, NC (US); Hao Zhang, Twinsburg, OH (US); Satish Kumar Raju Kalidindi, Mayfield Heights, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 18/576,264

(22) PCT Filed: Dec. 20, 2021

(86) PCT No.: PCT/US2021/064264
§ 371 (c)(1),
(2) Date: Jan. 3, 2024

(87) PCT Pub. No.: WO2023/063967
PCT Pub. Date: Apr. 20, 2023

(65) Prior Publication Data
US 2024/0309867 A1 Sep. 19, 2024

Related U.S. Application Data

(60) Provisional application No. 63/255,084, filed on Oct. 13, 2021.

(51) Int. Cl.
*F04C 2/10* (2006.01)
*F04C 15/00* (2006.01)

(52) U.S. Cl.
CPC ..... *F04C 2/101* (2013.01); *F04C 15/0023* (2013.01); *F04C 2240/54* (2013.01); *F04C 2240/56* (2013.01)

(58) Field of Classification Search
CPC .. F04C 2/101; F04C 15/0023; F04C 2240/54; F04C 2240/56
See application file for complete search history.

(56) References Cited

U.S. PATENT DOCUMENTS 1,773,211 A * 8/1930 Wilsey ..... F04C 2/101 418/16
2,940,399 A 6/1960 Zieg et al.
(Continued)

FOREIGN PATENT DOCUMENTS

CN 203362505 U 12/2013
CN 203627216 U 6/2014
(Continued)

OTHER PUBLICATIONS

Machine Translation and Foreign Patent for Chinese Patent Publication CN 209369985 U; Ist Inventor: Zhang; Title: Cycloid Hydraulic Motor; Publication Date: Sep. 10, 2019. (Year: 2019).*
(Continued)

*Primary Examiner* — Mary A Davis
(74) *Attorney, Agent, or Firm* — McDonnell Boehnen Hulbert & Berghoff LLP

(57) ABSTRACT

An example gear pump includes a pump ring gear; a pump shaft; a pump pinion mounted to the pump shaft and disposed within the pump ring gear, such that external teeth of the pump pinion engage with internal teeth of the pump ring gear, wherein the pump shaft is configured to rotate the pump pinion, thereby rotating the pump ring gear engaged therewith to displace fluid from an inlet chamber to an outlet chamber; one or more cross-holes; a bushing disposed about the pump shaft; and a pocket formed about a portion of the
(Continued)

bushing, wherein the one or more cross-holes fluidly couple the outlet chamber to the pocket, thereby causing fluid in the pocket to apply a supporting force to the pump shaft.

11 Claims, 7 Drawing Sheets

(56) References Cited

U.S. PATENT DOCUMENTS

| | | | | |
|---|---|---|---|---|
| 6,743,005 | B1 | 6/2004 | Leemhuis | |
| 9,945,377 | B2 * | 4/2018 | Pippes | F04C 2/101 |

FOREIGN PATENT DOCUMENTS

| | | | | |
|---|---|---|---|---|
| DE | 102004021216 | A1 | | 11/2005 |
| DE | 102008053318 | A1 | | 4/2010 |
| GB | 719974 | A | * | 12/1954 |
| JP | 2009-115039 | A | | 5/2009 |
| JP | 2014 062483 | A | | 4/2014 |
| WO | 2021/011155 | A1 | | 1/2021 |

OTHER PUBLICATIONS

Machine Translation and Foreign Patent for Chinese Patent Publication CN 111089050 A; 1st Inventor: Wang; Title: Bidirectional Gear Motor Pump; Publication Date: May 1, 2020. (Year: 2020).*

International Search report and Written Opinion prepared by the European Patent Office in application No. PCT/US2021/064264 dated Jul. 4, 2022.

Notice of the Reason for Refusal issued by the Japanese Patent Office in application No. 2024-508963, dated Jan. 7, 2025.

* cited by examiner

HYDRAULIC GEAR PUMP WITH HYDROSTATIC SHAFT BEARING AND ISOLATED CASE DRAIN AND METHOD OF OPERATING A HYDRAULIC GEAR PUMP

CROSS-REFERENCE TO RELATED APPLICATION

This application claims priority to U.S. Provisional Application No. 63/255,084, filed Oct. 13, 2021, which is incorporated herein by reference in its entirety.

BACKGROUND

A gear pump uses the meshing of gears to pump fluid by displacement. There are two main variations: external gear pumps, which use two external spur gears, and internal gear pumps, which use an external (e.g., pinion) and internal (e.g., ring) spur gears. Gear pumps have fixed displacement, where the pump can provide a constant amount of fluid for each revolution.

In some cases, such as during stall condition, a gear pump can operate in a state where the pump maintains a rated pressure at zero discharge flow. In other words, the pump maintains a high pressure level at the outlet port of the pump without providing fluid flow therefrom. In this condition, the gears of the pump rotate at a low speed, under high torque loads.

It may be desirable in such condition (e.g., stall condition) to configure the pump such that a small amount of fluid comes out of the pump to cool the internal components of the pump, and having a low cost shaft bearing that operates at low speeds to support high loads of the pump shaft. It is with respect to these and other considerations that the disclosure made herein is presented.

SUMMARY

The present disclosure describes implementations that relate to a hydraulic gear pump with hydrostatic shaft bearing and isolated case drain.

In a first example implementation, the present disclosure describes a gear pump. The gear pump includes: a pump ring gear; a pump shaft; a pump pinion mounted to the pump shaft and disposed within the pump ring gear, such that external teeth of the pump pinion engage with internal teeth of the pump ring gear, wherein the pump shaft is configured to rotate the pump pinion, thereby rotating the pump ring gear engaged therewith to displace fluid from an inlet chamber to an outlet chamber of the gear pump; a pump cover comprising one or more cross-holes and a pocket; and a bushing disposed about the pump shaft, wherein an exterior surface of the bushing interfaces with an interior surface of the pump cover, wherein the pocket is formed about a portion of the bushing, wherein the one or more cross-holes of the pump cover fluidly couple the outlet chamber to the pocket, thereby causing fluid in the pocket to apply a supporting force to the pump shaft.

In a first example implementation, the present disclosure describes a method. The method includes: rotating a pump shaft of a gear pump, wherein a pump pinion is mounted to the pump shaft and disposed within a pump ring gear of the gear pump, such that external teeth of the pump pinion engage with internal teeth of the pump ring gear, and wherein rotating the pump shaft rotates the pump pinion, thereby rotating the pump ring gear engaged therewith to displace fluid from an inlet chamber to an outlet chamber of the gear pump; providing fluid from the outlet chamber to a pocket formed about a portion of a bushing disposed about the pump shaft; applying a supporting force to the pump shaft by fluid in the pocket; and draining fluid that has applied the supporting force to a drain port that is isolated from the inlet chamber.

The foregoing summary is illustrative only and is not intended to be in any way limiting. In addition to the illustrative aspects, implementations, and features described above, further aspects, implementations, and features will become apparent by reference to the figures and the following detailed description.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying Figures.

DETAILED DESCRIPTION

The present disclosure relates to a gear pump that can operate a significant amount of time at zero discharge flow and high pressure. Gear pumps can generate large shaft bearing loads during operation. Applications that require long life at low speeds have difficulties using traditional journal bearings because the low speed cannot generate the required hydrodynamic film needed to adequately support the shaft. Roller element bearings can be used but are costly and drive weight.

Disclosed herein is a gear pump configured with hydrostatic bearings that are low cost, effective at low speeds, compact, and weight efficient. Particularly, to implement a hydrostatic bearing, the disclosed pump is configured to provide a high pressure leakage fluid that is directed to a hydraulic area that can provide a supporting force for the pump shaft.

Further, the disclosed gear pump is configured to provide the fluid used to support the shaft in the hydrostatic bearing to a separate case drain to cool the internal components of the gear pump. The case drain is isolated from the inlet so that the leakage fluid does not recirculate. As such, the high pressure leakage fluid is used to both support the shaft via a hydrostatic bearing configuration and cool the gear pump as it is provided to an isolated case drain.

Figure 1:
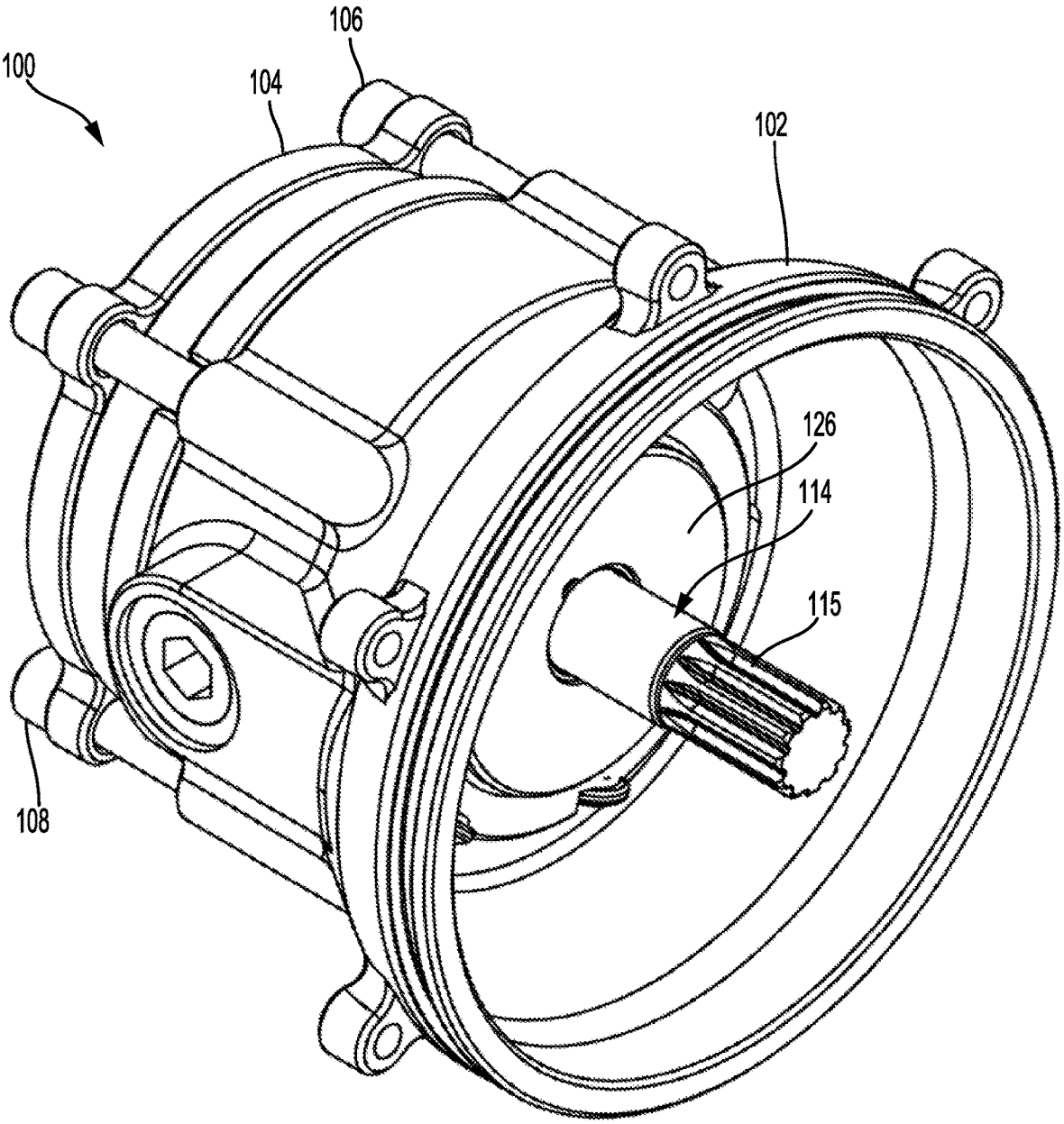
FIG. 1 illustrates a perspective partial view of a gear pump, in accordance with an example implementation.
Figure 2:
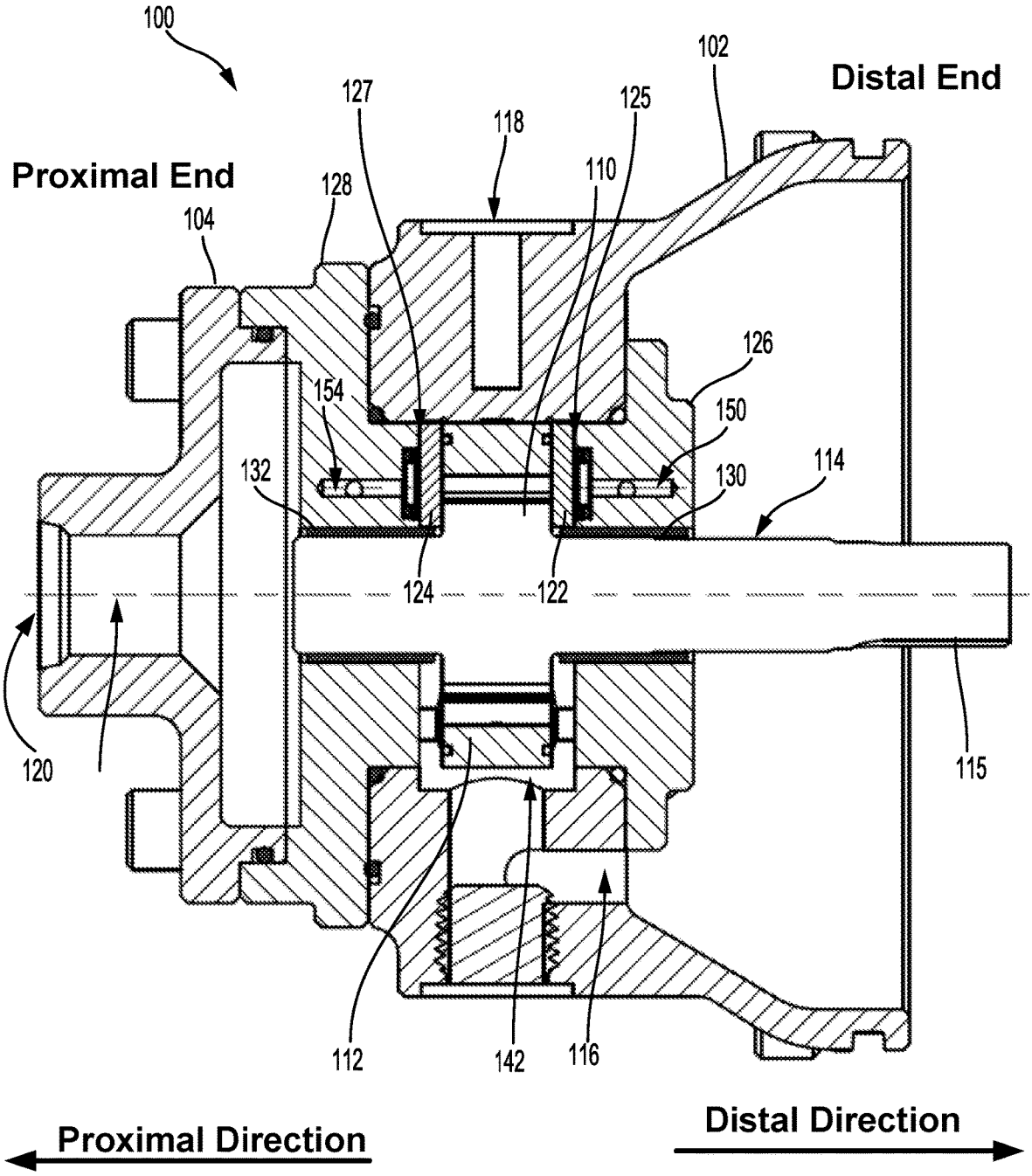
FIG. 2 illustrates a cross-sectional view of the gear pump of FIG. 1, in accordance with an example implementation.
Figure 3:
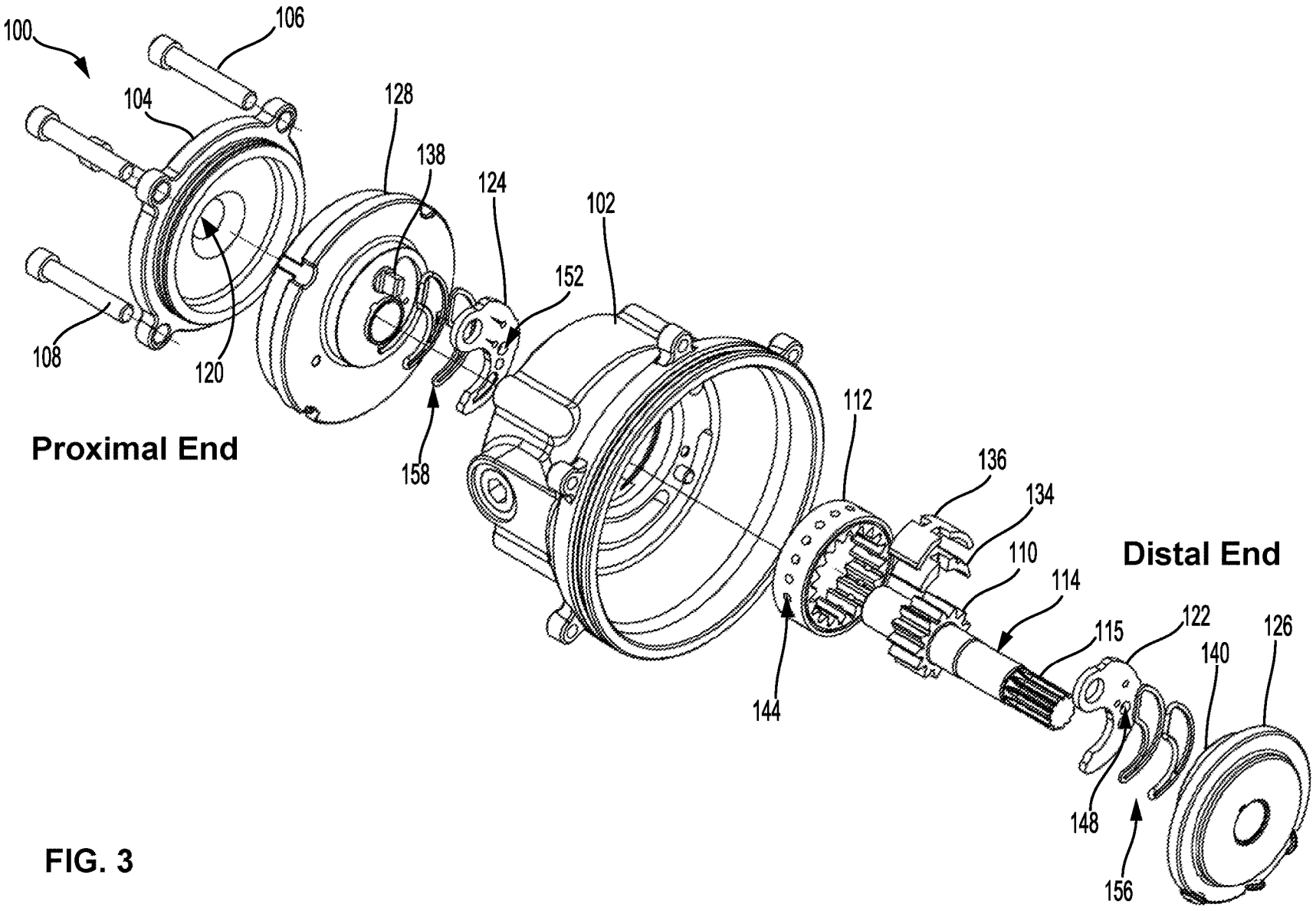
FIG. 3 illustrates a perspective exploded view of the gear pump of FIG. 1, in accordance with an example implementation.

FIG. 1 illustrates a perspective partial view of a gear pump 100, FIG. 2 illustrates a cross-sectional view of the gear pump 100, and FIG. 3 illustrates a perspective exploded view of the gear pump 100, in accordance with an example implementation. FIGS. 1-3 are described together.

The gear pump 100 has a pump housing 102 configured to house components of the gear pump 100. The gear pump 100 further includes an end cover 104 that is coupled to the pump housing 102. For example several fasteners, such as fastener 106 and fastener 108, can be disposed in a circular array and are used to couple the end cover 104 to the pump housing 102.

In an example, the gear pump 100 can have another end cover coupled to the pump housing 102 and mounted to the other end of the pump housing 102 opposite the end cover 104. In another example, the gear pump 100 can be a part of a larger assembly that includes an electric motor, for example. In this example, the electric motor can interface with the gear pump 100 via the pump housing 102.

As shown in FIGS. 2-3, the gear pump 100 is configured as an internal gear pump having a pump pinion 110 (e.g., a spur gear having external teeth formed in an exterior peripheral surface thereof) and a pump ring gear 112 (e.g., ring gear having internal teeth formed in an interior peripheral surface thereof) disposed within the pump housing 102. The pump pinion 110 is mounted to, or is an integral portion of, a pump shaft 114, and the teeth of the pump pinion 110 engage with the teeth of the pump ring gear 112. Further, the pump pinion 110 is mounted off-center relative to the pump ring gear 112, i.e., a center of rotation of the pump pinion 110 is eccentric relative to or offset from a center of rotation of the pump ring gear 112. In examples, the pump shaft 114 can be rotatably coupled to a gearbox or a rotor of a motor via splines 115 to provide rotary motion to the pump pinion 110 and the pump ring gear 112 via the pump shaft 114.

The gear pump 100 can have an inlet port formed in a front end cover coupled to the pump housing 102 or coupled to an assembly that includes the gear pump 100, for example. The inlet port provides fluid to an inlet passage 116 formed in the pump housing 102 as shown in FIG. 2. The gear pump 100 also has an outlet port 118 formed in the pump housing 102, through which fluid is discharged from the gear pump 100 to a hydraulic consumer, e.g., a hydraulic actuator. The gear pump 100 further has a drain port 120 formed in the end cover 104. The drain port 120 is separate and isolated from the inlet port of the gear pump 100.

The pump ring gear 112 and the pump pinion 110 are supported axially within the pump housing 102 via (i) a first thrust plate 122 disposed on distal sides of the pump ring gear 112 and the pump pinion 110, and (ii) a second thrust plate 124 on the proximal sides of the pump ring gear 112 and the pump pinion 110. As such, the pump pinion 110 and the pump ring gear 112 are interposed or sandwiched between the thrust plates 122, 124.

The thrust plates 122, 124 are configured to be kidney-shaped as shown in FIG. 3. As described below, the thrust plates 122, 124 can operate as axial compensator that can reduce the leakage within the gear pump 100 and improve its efficiency.

The thrust plates 122, 124 are in turn supported by a first pump cover 126 and a second pump cover 128. Particularly, as shown in FIG. 2, the first thrust plate 122 is interposed axially between the pump ring gear 112 and the first pump cover 126, and the first thrust plate 122 interfaces with the first pump cover 126 at an interface 125. The second thrust plate 124 is interposed axially between the pump ring gear 112 and the second pump cover 128, and the second thrust plate 124 interfaces with the second pump cover 128 at an interface 127. The term "interface" is used herein to indicate a point, plane, or space (or a portion of the plane or space) where two components meet and interact (e.g., where the thrust plates 122, 124 meet and interact with the pump covers 126, 128, respectively).

With this configuration, components of the gear pump 100 are interposed between and supported by the pump covers 126, 128. As depicted in FIG. 2, the pump covers 126, 128 include respective central through-holes to accommodate the pump shaft 114 therethrough. The thrust plates 122, 124 are not fastened to the pump covers 126, 128, but are rather configured as floating components that can move axially as described below to make up for any axial clearances and reduce internal leakage within the gear pump 100.

Further, the gear pump 100 includes a bushing 130 and a bushing 132 disposed about the pump shaft 114 between its exterior surface and the interior surfaces of the pump covers 126, 128 and the thrust plates 122, 124. As such, the bushing 130 is disposed, at least partially, within the pump cover 126 and the bushing 132 is disposed, at least partially, within the pump cover 128. The bushings 130, 132 are configured as bearings that facilitate rotation of the pump shaft 114, and can be referred to as bushing bearings, sleeve bearings, or journal bearings. Further, as described in more detail below, the bushings 130, 132 operate as hydrostatic bearings that support the pump shaft 114 at low rotational speeds of the pump shaft 114.

Further, as shown in FIG. 3, the gear pump 100 includes an inner crescent 134 and an outer crescent 136. The terms "inner" and "outer" indicate radial positioning of the crescents, where the inner crescent 134 is disposed radially inward relative to the outer crescent 136.

The inner crescent 134 and the outer crescent 136 are axially supported within the internal space between the pump ring gear 112 and the pump pinion 110 by a first locating pin 138 coupled to the second pump cover 128 and a second locating pin 140 (shown partially in the view of FIG. 3) coupled to the first pump cover 126. The first locating pin 138 axially interfaces with proximal ends of the crescents 134, 136. Similarly, the second locating pin 140 axially interfaces with distal ends of the crescents 134, 136. With this configuration, the inner crescent 134 and the outer crescent 136 are held axially in position by the locating pins 138, 140, and the locating pins 138, 140 also maintain the orientation of the crescents 134, 136.

During operation, fluid is provided through an inlet port, then through the inlet passage 116 to an inlet chamber 142 shown in FIG. 2. As the pump shaft 114 rotates, the pump pinion 110 rotates and cause the pump ring gear 112 to rotate therewith due to the engagement of their teeth.

As mentioned above, the center of rotation of the pump pinion 110 is offset from the center of rotation of the pump ring gear 112. Thus, as the external gear teeth of the pump pinion 110 and the internal gear teeth of the pump ring gear 112 separate or disengage, they create an expanding volume (i.e., expanding chamber). The expanding volume collectively represents multiple pockets formed between the separating teeth. The expanding volume operates as a suction void forming between the separating teeth on the intake side of the gear pump 100 that is fluidly-coupled to the inlet chamber 142, which is fluidly-coupled to an inlet port via the inlet passage 116.

As shown in FIG. 3, the pump ring gear 112 has a plurality of radial cross-holes, such as cross-hole 144, disposed in a circumferential array about the pump ring gear 112. Fluid from the inlet chamber 142 flows from the distal end and proximal end of the pump ring gear 112 as well as through the radial cross-holes of the pump ring gear 112 to fill the expanding volume between the teeth.

Figure 4:
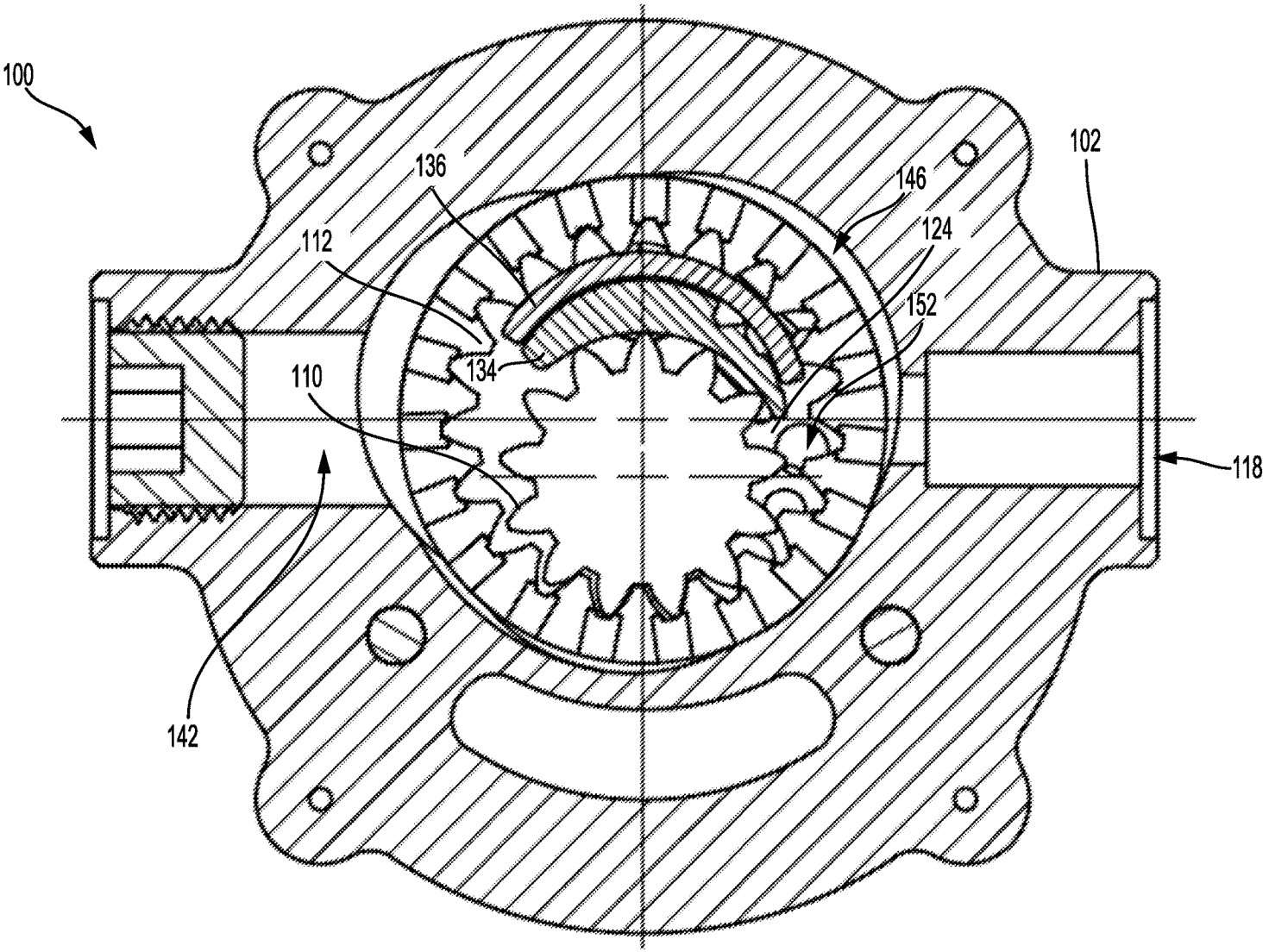
FIG. 4 illustrates a partial front cross-sectional view of the gear pump of FIG. 1, in accordance with an example implementation.

FIG. 4 illustrates a partial front cross-sectional view of the gear pump 100, in accordance with an example implementation. The meshing of the gear teeth of the pump pinion 110 and the pump ring gear 112 as they rotate displaces the fluid. In other words, as the teeth of the pump pinion 110 and the pump ring gear 112 become interlocked on the discharge side of the gear pump 100, the volume is reduced and the fluid is forced out under pressure through the radial cross-holes of the pump ring gear 112 to an outlet chamber 146 shown in FIG. 4, then to the outlet port 118.

As the teeth of the pump pinion 110 and the pump ring gear 112 mesh, they form a seal between the expanding volume having low pressure fluid received from the inlet port and the volume between teeth that are meshing or are about to mesh coupled to the outlet port 118. The seal created by the meshed teeth forces the fluid out of the discharge port and prevents fluid from flowing backward.

Further, as the pump pinion 110 and the pump ring gear 112 rotate, the crescents 134, 136 divide the fluid as it is being carried from the low pressure suction expanding volume to the outlet chamber 146 coupled to the outlet port 118. Thus, the crescents 134, 136 can form a seal between the low pressure volume and the high pressure volume.

Particularly, the outer surface (i.e., radially outward surface) of the outer crescent 136 interfaces with the inner teeth of the pump ring gear 112 to create a seal therebetween. An effective seal between the outer surface of the outer crescent 136 and the inner teeth of the pump ring gear 112 may preclude leakage from the high pressure volume to the low pressure volume. The terms "preclude" or "block" fluid flow is used herein to indicate substantially preventing fluid flow except for minimal flow of drops per minute, for example.

In a similar manner, the inner surface (i.e., radially inward surface) of the inner crescent 134 interfaces with the external teeth of the pump pinion 110 to create a seal therebetween. An effective seal between the inner surface of the inner crescent 134 and the external teeth of the pump pinion 110 may preclude leakage from the high pressure volume to the low pressure volume.

The configuration of the crescents 134, 136 provides for an effective seal and compensates for radial clearances between the crescents 134, 136 and the gear teeth to create an effective seal. Particularly, fluid from either the expanding volume or the high pressure volume seeping through the interface between the outer crescent 136 and the inner crescent 134 can push the crescents 134, 136 radially apart. Particularly, the fluid between the crescents 134, 136 can then push the outer crescent 136 radially outward toward the inner teeth of the pump ring gear 112, thereby eliminating any radial space or clearance therebetween and forming an effective seal. Similarly, the fluid between the crescents 134, 136 can push the inner crescent 134 radially inward toward the external teeth of the pump pinion 110, thereby eliminating any radial space or clearance therebetween and forming an effective seal.

As shown in FIG. 3, on the distal side of the pump pinion 110 and the pump ring gear 112, the first thrust plate 122 can have through holes, such as a through-hole 148, that allow fluid communication of high pressure fluid at the discharge side (e.g., from the outlet chamber 146) to flow to blind hole 150 formed in the pump cover 126 shown in FIG. 2. Similarly, on the proximal side of the pump pinion 110 and the pump ring gear 112, the second thrust plate 124 can have through-holes, such as through-hole 152, that allow fluid communication of high pressure fluid at the discharge side (e.g., from the outlet chamber 146) to flow to blind hole 154 formed in the pump end cover 126 as shown in FIG. 2. High pressure fluid in the outlet chamber 146 (see FIG. 4) can thus be communicated axially in both directions via the through-holes 148, 152 in the thrust plates 122, 124. High pressure fluid thus reaches the interfaces 125, 127 between the thrust plates 122, 124 and the pump covers 126, 128, respectively.

Fluid trapped at the interface 125 between the first thrust plate 122 and the first pump cover 126 applies an axial fluid force on the first thrust plate 122 toward distal end faces of the pump pinion 110 and the pump ring gear 112. This way, a metal-to-metal seal is created between the first thrust plate 122 and the distal end faces of the pump pinion 110 and the pump ring gear 112. Similarly, fluid trapped at the interface 127 between the second thrust plate 124 and the second pump cover 128 applies an axial fluid force on the second thrust plate 124 toward proximal end faces of the pump pinion 110 and the pump ring gear 112. This way, a metal-to-metal seal is created between the second thrust plate 124 and the proximal end faces of the pump pinion 110 and the pump ring gear 112.

The fluid forces acting on the thrust plates 122, 124 toward the pump pinion 110 and the pump ring gear 112 pushes or squeezes the thrust plates 122, 124 axially against the pump pinion 110 and the pump ring gear 112, thereby creating an effective seal and eliminating any axial gaps therebetween. As such, the thrust plates 122, 124 can be referred to as axial compensators as they can compensate for any axial gaps between the thrust plates 122, 124 and the pump pinion 110 and the pump ring gear 112 disposed therebetween, thereby reducing leakage and improving efficiency of the gear pump 100.

Referring to FIG. 3, the gear pump 100 includes a first set of kidney-shaped seals 156 that can be disposed in contoured cavities or recesses in a proximal side of the first pump cover 126, where the recesses have a shape matching the shape of the first set of kidney-shaped seals 156. Thus, the first set of kidney-shaped seals 156 can be placed on the proximal side of the first pump cover 126 facing the first thrust plate 122. With this configuration, the first set of kidney-shaped seals 156 isolate or seal high pressure fluid (from the high pressure volume) communicated to the interface 125 from low pressure fluid being provided to the inlet passage 116. The first set of kidney-shaped seals 156 may thus preclude cross-flow or leakage from the high pressure side to the low pressure side.

Similarly, the gear pump 100 can include a second set of kidney-shaped seals 158 disposed in contoured cavities or recesses in a distal side of the second pump cover 128, where the recesses have a shape matching the shape of the second set of kidney-shaped seals 158. Thus, the second set of kidney-shaped seals 158 is placed on the distal side of the second pump cover 128 facing the second thrust plate 124. The second set of kidney-shaped seals 158 may isolate or seal high pressure fluid (from the high pressure volume) communicated to the interface 127 from low pressure fluid. The second set of kidney-shaped seals 158 may thus precludes cross-flow or leakage from the high pressure side to the low pressure side.

In an example, the sets of kidney-shaped seals 156, 156 can each include a main seal and a back-up seal. In another example, sets of kidney-shaped seals 156, 156 can each include a main seal and a seal support layer.

Under some operating conditions, such as in a stall condition, the gear pump 100 may be required to hold a rated pressure (e.g., 3000 pounds per square inch) at the outlet port 118 while discharging no fluid from the outlet port 118. For example, if the gear pump 100 is providing fluid to a hydraulic actuator (e.g., a hydraulic cylinder) and the hydraulic actuator is required to hold a load without moving it, then the gear pump 100 may be required to hold the rated pressure sufficient to hold the load, without providing fluid flow.

Under such condition, the pump shaft 114 can rotate at a low speed (e.g., 50-200 revolutions per minute) and is subjected to a high torque load to maintain the rated pressure without providing substantial fluid flow. In other words, the pump pinion 110 and the pump ring gear 112 (and the pump shaft 114) rotate at a low speed, under high torque loads.

While no discharge fluid is provided from the outlet port 118 under such condition, a leakage amount of fluid is generated to facilitate holding the rates pressure as the pump shaft 114 rotates at the low speed. The gear pump 100 is configured to use such leakage fluid to support the load on the pump shaft 114 as well as route the fluid to the drain port 120, which is isolated from the inlet port, to remove heat and cool the gear pump 100.

As described above, the blind holes 150, 154 transmit high pressure fluid to the interfaces 125, 127 to press the thrust plates 122, 124 against the pump pinion 110 and the pump ring gear 112. Additionally, the pump covers 126, 128 have cross-holes that transmit the high pressure fluid in the blind holes 150, 154, respectively, to the bushings 130, 132 to facilitate operating the bushings 130, 132 as hydrostatic bearings capable of supporting loads on the pump shaft 114 when the pump shaft 114 rotates at low speeds.

Figure 5:
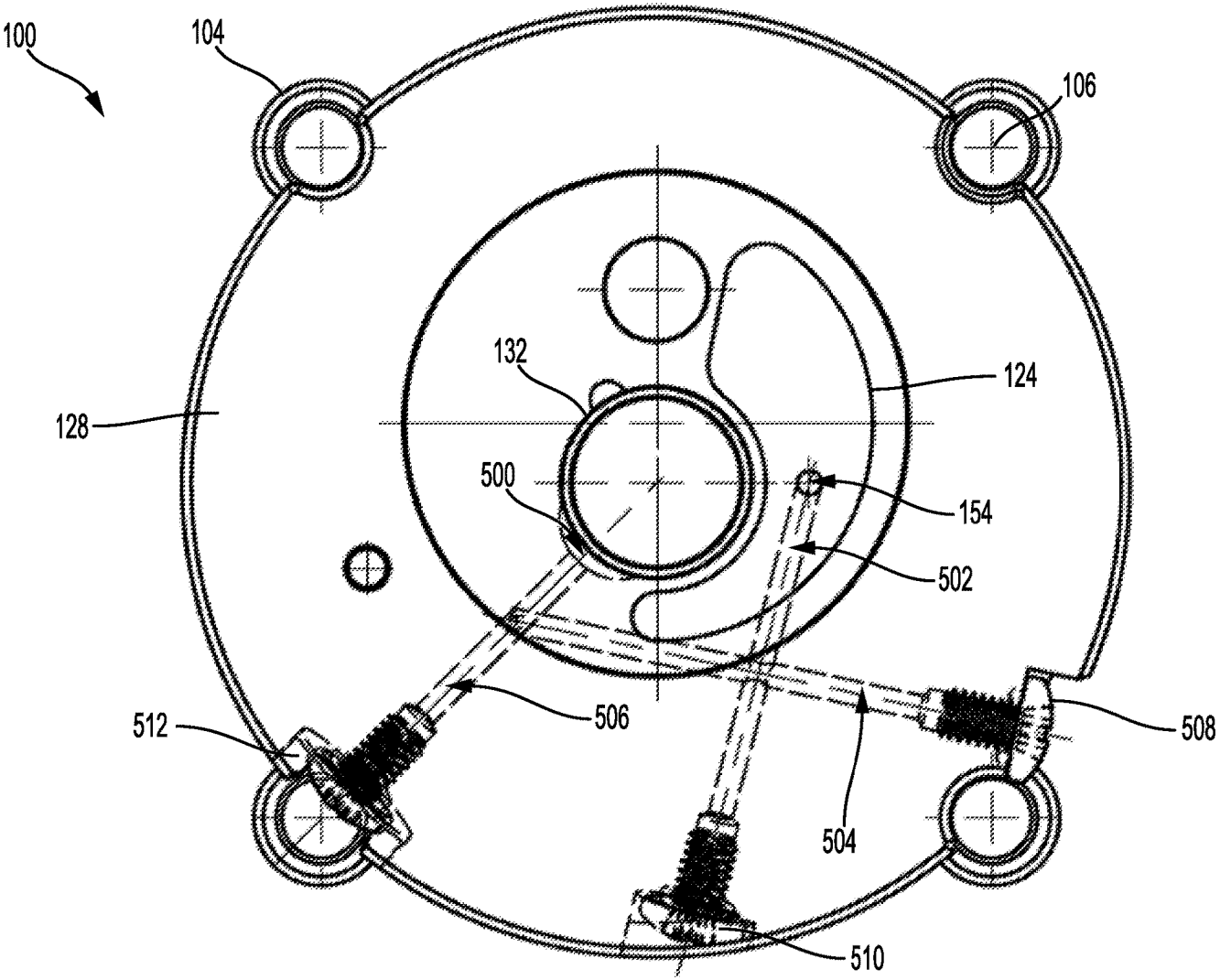
FIG. 5 illustrates a partial front view of the gear pump of FIG. 1, in accordance with an example implementation.

FIG. 5 illustrates a partial front view of the gear pump 100, in accordance with an example implementation. As depicted, the second pump cover 128 has cross-holes that are configured to transmit high pressure fluid in the blind hole 154 to a groove or a pocket 500 formed about a portion of the bushing 132, e.g., underneath the bushing 132.

Particularly, the second pump cover 128 has one or more cross-holes configured to communicate high pressure fluid from the blind hole 154 to the pocket 500. For example, the pump cover 128 can include a first cross-hole 502 that is cross-drilled in the second pump cover 128 to reach the blind hole 154. A second cross-hole 504 is cross-drilled in the second pump cover 128 to fluidly couple the first cross-hole 502 to a third cross-hole 506 that is also cross-drilled in the second pump cover 128.

The term "cross-hole" is used herein to encompass any type of opening (e.g., slot, window, hole, etc.) that crosses a path of, or is formed transverse relative to, another hole, cavity, or channel. The cross-holes 502-506 are plugged via plug 508, plug 510, and plug 512, respectively, after being cross-drilled in the second pump cover 128.

High pressure fluid received from the blind hole 154 is thus communicated to the third cross-hole 506 via the first cross-hole 502 and the second cross-hole 504. The third cross-hole 506 then provides the high pressure fluid to the pocket 500.

Figure 6:
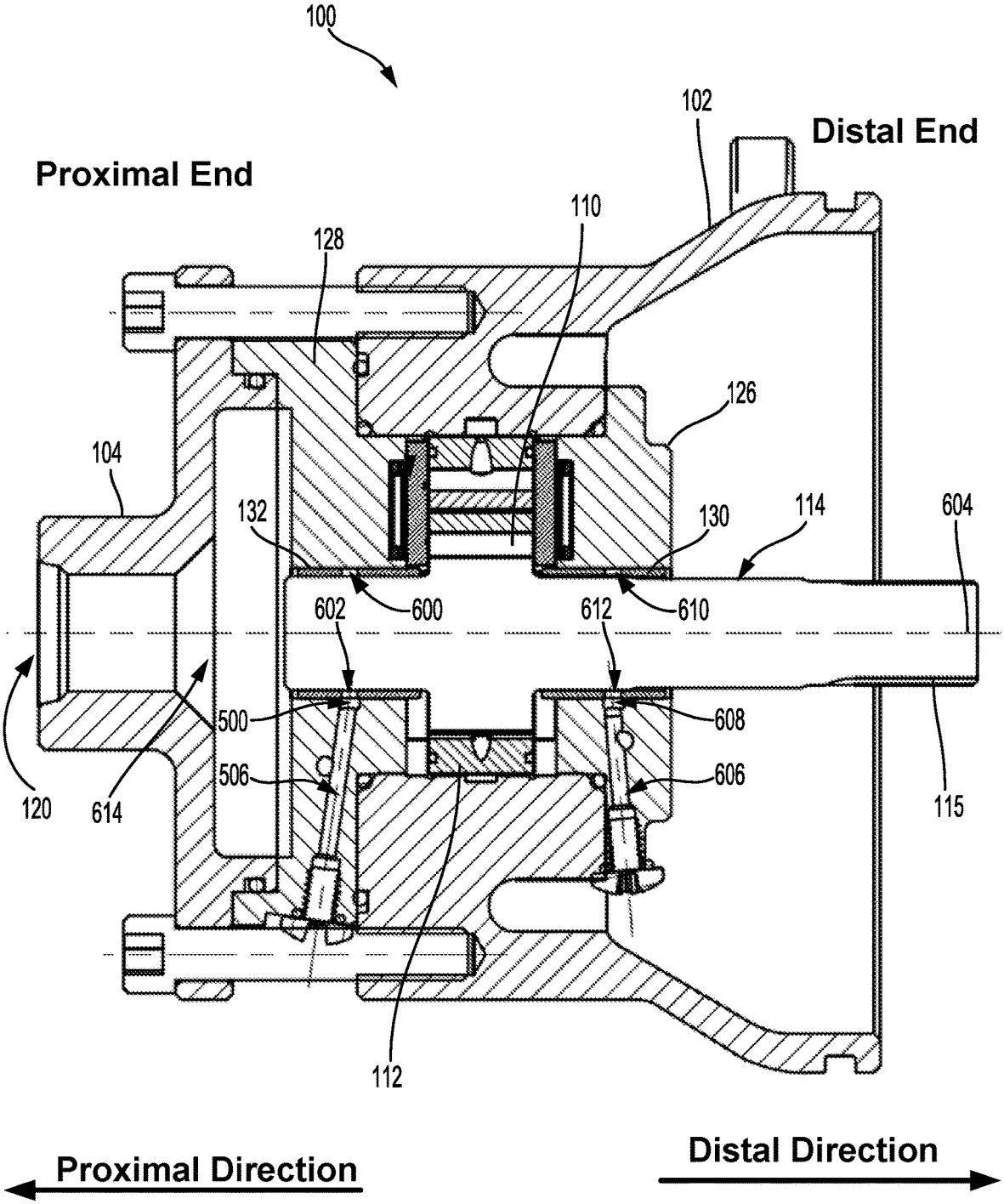
FIG. 6 illustrates another cross-sectional view of the gear pump of FIG. 1, in accordance with an example implementation.

FIG. 6 illustrates another cross-sectional view of the gear pump 100, in accordance with an example implementation. The cross-section of FIG. 6 is taken across a plane that is different from the plane of the cross sectional view of FIG. 2. In the cross-sectional view of FIG. 6, the third cross-hole 506 is shown in the second pump cover 128.

As shown in FIG. 6, the bushing 132 has a cross-hole 600 and a cross-hole 602. The cross-hole 600 can receive high pressure fluid from the outlet chamber 146 flowing through unsealed spaces to the exterior surface of the bushing 132. Fluid is then communicated to within the bushing 132 at the interface between the interior surface of the bushing 132 and the exterior surface of the pump shaft 114. This high pressure fluid supports the pump shaft 114 from one side (e.g., upper side).

The cross-holes 502-506 are configured to provide the high pressure fluid to the opposite side of the bushing 132. Referring to FIGS. 5-6 together, the high pressure fluid in the blind hole 154 flows through the first cross-hole 502, then the second cross-hole 504, and the third cross-hole 506 to the pocket 500. As shown in FIG. 6, the pocket 500 is fluidly-coupled to, and aligned with, the cross-hole 602 of the bushing 132. This way, high pressure fluid is provided to the interface between the interior surface of the bushing 132 and the exterior surface of the pump shaft 114 at the opposite side (e.g., bottom side) of the bushing 132.

With this configuration, the bushing 132 operates as a hydrostatic bearing for the pump shaft 114 disposed therethrough. In particular, when the pump shaft 114 rotates at low speeds where no fluid is discharged from the outlet port 118, high pressure fluid resulting from rotation of the pump pinion 110 and the pump ring gear 112 can be considered as a leakage fluid flow. Such leakage fluid flow is provided to the pocket 500 disposed substantially underneath the bushing 132, and fluid is then provided through the cross-hole 602 to within the bushing 132 at the interface between the interior surface of the bushing 132 and the exterior surface of the pump shaft 114. The high pressure fluid applies a radially-inward force on the pump shaft 114 that opposes or provides a supporting force against the weight of the pump shaft 114 and against any torque loads applied to the pump shaft 114 during stall (low speed) conditions.

As such, the bushing 132 operates as a sleeve or shell of a hydrostatic journal bearing that supports radial loading acting in a direction perpendicular to longitudinal axis 604 of the pump shaft 114. The radial loading is due to the downward loads on, or weight of, the pump shaft 114. The bushing 130 is configured similar to the bushing 132 and the first pump cover 126 is configured similar to the second pump cover 128 such that the bushing 130 operates as another hydrostatic bearing for the pump shaft 114 spaced axially-apart from the bushing 132 along the longitudinal axis 604 of the pump shaft 114.

Particularly, the first pump cover 126 can have a plurality of cross-holes, including cross-hole 606 shown in FIG. 6, to provide high pressure fluid from the blind hole 150 (see FIG. 2) to a pocket 608 that is similar to the pocket 500. The bushing 130 includes cross-hole 610 and cross-hole 612 that are similar to the cross-holes 600, 602, respectively, of the bushing 132. The pocket 608 thus provides high pressure fluid to the cross-hole 612, then to the interface between the interior surface of the bushing 130 and the exterior surface of the pump shaft 114 to support the pump shaft 114 at low rotational speeds.

The bushings 130, 132 straddle the pump pinion 110 and the pump ring gear 112 and are disposed axially-apart along a length of the pump shaft 114. This configuration may provide enhanced support for the pump shaft 114.

If the leakage fluid flow provided to the pockets 500, 608 to support the pump shaft 114 is then allowed to join the inlet fluid received at the inlet port, fluid would be recirculating without allowing low temperature fluid to enter the gear pump 100. Recirculating fluid through the gear pump 100 could limit the amount of heat that can be removed. Further, a large pressure drop would occur from the high pressure level of fluid discharged by the pump pinion 110 and the pump ring gear 112 and fluid provided back to the inlet port, which has fluid at a low pressure (e.g., atmospheric pressure). Such large pressure drop indicates a power loss in the form of heat generated from the gear pump 100. In other words, the flow of such leakage fluid might not be effective in cooling the gear pump 100 during stall condition where no fluid is discharged from the gear pump 100.

To alleviate this issue, the gear pump 100 is configured to provide the leakage fluid flow to the drain port 120, which is isolated from the inlet port and disposed downstream from the pocket 500. For example, fluid provided from the pocket 500 flows through the cross-hole 602 to the interface between the interior surface of the bushing 132 and the exterior surface of the pump shaft 114, and is then squeezed or discharged to a chamber 614 formed within the end cover 104, and then flows to the drain port 120. In another example implementation, fluid can be directed through a hole in the pump shaft 114, then through a channel through the pump shaft 114 to the chamber 614.

Thus, fluid drawn from the inlet port to generate the leakage fluid is not recirculating back to the inlet port. Further, the drain port 120 is allowed to have a higher pressure level than fluid provided to the inlet port of the gear pump 100. This way, pressure drop between the high pressure fluid provided to the pocket 500 and the drain port 120 is smaller compared to a pressure drop between the fluid provided to the pocket 500 and the inlet port. As such, providing leakage fluid to the drain port 120 may enhance cooling of the gear pump 100 under stall, low speed conditions.

Although the description above involves an internal gear pump as an example for illustration, the implementation of providing high pressure fluid to a bushing to support a pump shaft and draining the fluid to an isolated port can be applied to an external gear pump.

Figure 7:
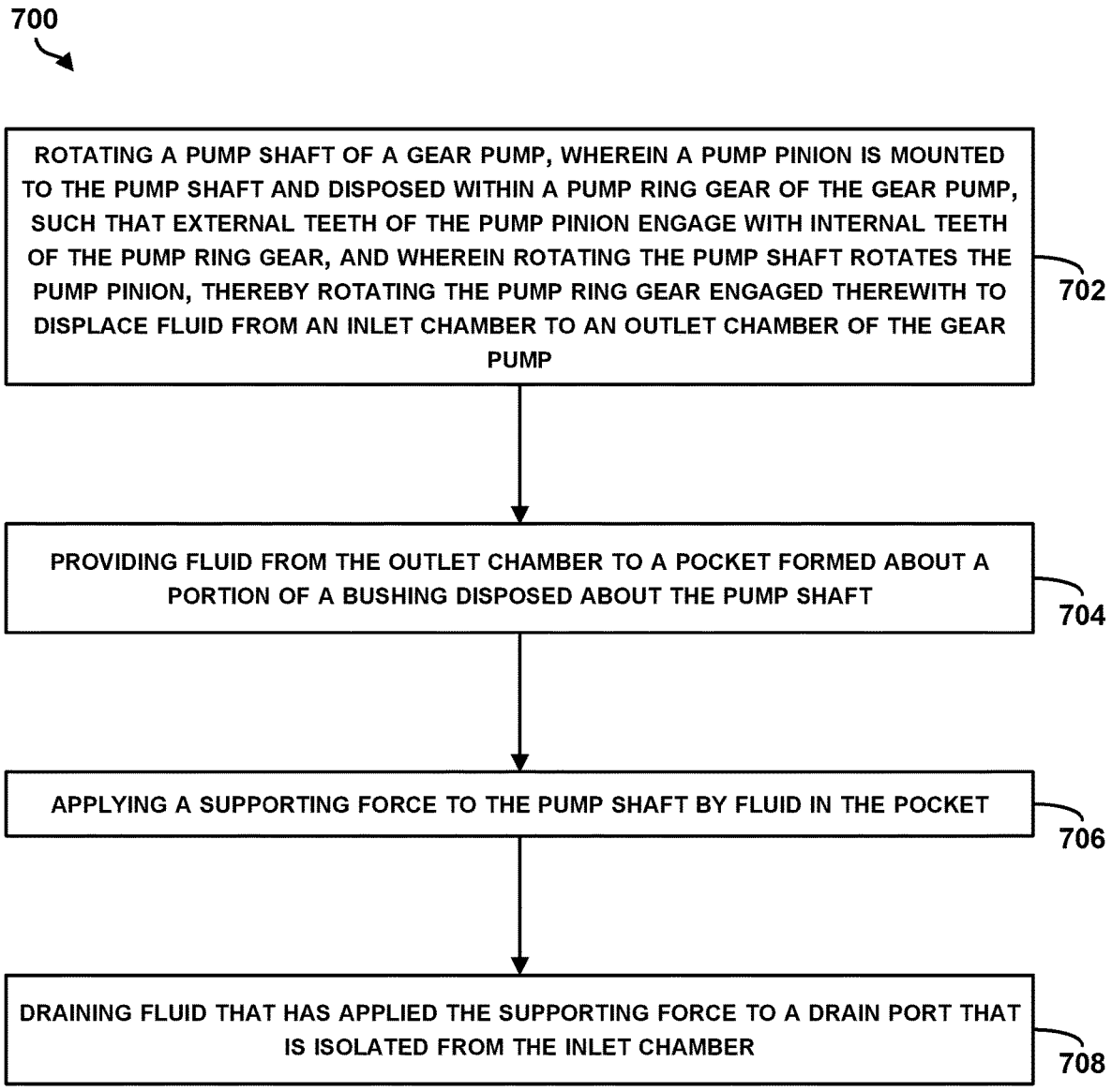
FIG. 7 is a flowchart of a method for operating a gear pump, in accordance with an example implementation.

FIG. 7 is a flowchart of a method 700 for operating the gear pump 100, in accordance with an example implementation. The method 700 may include one or more operations, functions, or actions as illustrated by one or more of blocks 702-708. Although the blocks are illustrated in a sequential order, these blocks may also be performed in parallel, and/or in a different order than those described herein. Also, the various blocks may be combined into fewer blocks, divided into additional blocks, and/or removed based upon the desired implementation. It should be understood that for this and other processes and methods disclosed herein, flowcharts show functionality and operation of one possible implementation of present examples. Alternative implementations are included within the scope of the examples of the present disclosure in which functions may be executed out of order from that shown or discussed, including substantially concurrent or in reverse order, depending on the functionality involved, as would be understood by those reasonably skilled in the art.

At block 702, the method 700 includes rotating the pump shaft 114 of the gear pump 100, wherein the pump pinion 110 is mounted to the pump shaft 114 and disposed within the pump ring gear 112 of the gear pump 100, such that external teeth of the pump pinion 110 engage with internal teeth of the pump ring gear 112, and wherein rotating the pump shaft 114 rotates the pump pinion 110, thereby rotating the pump ring gear 112 engaged therewith to displace fluid from an inlet chamber (e.g., the inlet chamber 142) to an outlet chamber (e.g., the outlet chamber 146) of the gear pump 100.

At block 704, the method 700 includes providing fluid from the outlet chamber to a pocket (e.g., the pocket 500 or the pocket 608) formed about a portion of a bushing (e.g., the bushing 130 or the bushing 132) disposed about the pump shaft 114.

At block 706, the method 700 includes applying a supporting force to the pump shaft 114 by fluid in the pocket At block 708, the method 700 includes draining fluid that has applied the supporting force to the drain port 120 that is isolated from the inlet chamber.

The method 700 can further include other steps described throughout herein. For example, the gear pump 100 can further include a pump cover (e.g., the first pump cover 126 or the second pump cover 128), wherein the pump cover comprises the pocket and comprises one or more cross-holes (e.g., the cross-holes 502-506) fluidly coupling the outlet chamber to the pocket, and wherein providing fluid from the outlet chamber to the pocket comprises: communicating fluid from the outlet chamber via the one or more cross-holes to the pocket.

In an example, the one or more cross-holes comprise: (i) the first cross-hole 502 fluidly-coupled to the outlet chamber, (ii) the second cross-hole 504 fluidly-coupled to the first cross-hole 502, and (iii) the third cross-hole 506 fluidly coupling the second cross-hole 504 to the pocket 500, and wherein communicating fluid from the outlet chamber via the one or more cross-holes to the pocket comprises: communicating fluid from the outlet chamber via the first cross-hole 502 to the second cross-hole 504; communicating fluid from the second cross-hole 504 to the third cross-hole 506; and communicating fluid from the third cross-hole 506 to the pocket 500.

The gear pump can further include a thrust plate (e.g., the first thrust plate 122 or the second thrust plate 124) interposed axially between the pump cover and the pump ring gear. The thrust plate can include through-holes (e.g., the through-hole 148 or the through-hole 152) fluidly-coupled to the outlet chamber, and wherein the pump cover comprises a blind hole (e.g., the blind hole 150 or the blind hole 154) that receives fluid from the through-holes of the thrust plate and is fluidly-coupled to the first cross-hole 502 of the pump cover. Communicating fluid from the outlet chamber via the first cross-hole includes: communicating fluid from the outlet chamber through the through-hole of the thrust plate to the blind hole; and communicating fluid from the blind hole via the first cross-hole to the second cross-hole.

Further, the bushing (e.g., the bushing 132) has a cross-hole (e.g., the cross-hole 602) fluidly-coupled to the pocket. The method can further include communicating fluid from the pocket via the cross-hole of the bushing to within the bushing at an interface between an exterior surface of the pump shaft 114 and an interior surface of the bushing, thereby causing the fluid to apply the supporting force to the pump shaft 114.

In addition to a first bushing (e.g., the bushing 130), the gear pump 100 can further include a second bushing (e.g., the bushing 132) disposed about the pump shaft 114 at a proximal side of the pump ring gear, and the method can further include providing fluid from the outlet chamber to a respective pocket (e.g., the pocket 500) formed about a portion of the second bushing, thereby causing fluid in the respective pocket to apply a respective supporting force to the pump shaft 114.

The detailed description above describes various features and operations of the disclosed systems with reference to the accompanying figures. The illustrative implementations described herein are not meant to be limiting. Certain aspects of the disclosed systems can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Further, devices or systems may be used or configured to perform functions presented in the figures. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide The arrangements described herein are for purposes of example only. As such, those skilled in the art will appreciate that other arrangements and other elements (e.g., machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. Also, the terminology used herein is for the purpose of describing particular implementations only, and is not intended to be limiting.

Embodiments of the present disclosure can thus relate to one of the enumerated example embodiments (EEEs) listed below.

EEE 1 is a gear pump comprising: a pump ring gear; a pump shaft: a pump pinion mounted to the pump shaft and disposed within the pump ring gear, such that external teeth of the pump pinion engage with internal teeth of the pump ring gear, wherein the pump shaft is configured to rotate the pump pinion, thereby rotating the pump ring gear engaged therewith to displace fluid from an inlet chamber to an outlet chamber of the gear pump; a pump cover comprising one or more cross-holes and a pocket; and a bushing disposed about the pump shaft, wherein an exterior surface of the bushing interfaces with an interior surface of the pump cover, wherein the pocket is formed about a portion of the bushing, wherein the one or more cross-holes of the pump cover fluidly couple the outlet chamber to the pocket, thereby causing fluid in the pocket to apply a supporting force to the pump shaft.

EEE 2 is the gear pump of EEE 1, further comprising: a thrust plate interposed axially between the pump cover and the pump ring gear, wherein the thrust plate comprises a through-hole fluidly-coupled to the outlet chamber, and wherein the pump cover comprises a blind hole receiving fluid from the through-hole of the thrust plate, and wherein a cross-hole of the one or more cross-holes of the pump cover is fluidly-coupled to the blind hole.

EEE 3 is the gear pump of EEE 2, wherein the one or more cross-holes comprise: a first cross-hole fluidly-coupled to the blind hole; a second cross-hole fluidly-coupled to the first cross-hole; and a third cross-hole fluidly coupling the second cross-hole to the pocket.

EEE 4 is the gear pump of any of EEEs 1-3, wherein the bushing has a cross-hole fluidly-coupled to the pocket and configured to communicate fluid from the pocket to within the bushing at an interface between an exterior surface of the pump shaft and an interior surface of the bushing, thereby causing the fluid to apply the supporting force to the pump shaft.

EEE 5 is the gear pump of any of EEEs 1-4, wherein the pocket is formed underneath the bushing.

EEE 6 is the gear pump of any of EEEs 1-5, wherein the bushing is a first bushing disposed at a distal side of the pump ring gear, and wherein the pump cover is a first pump cover disposed at the distal side of the pump ring gear, and wherein the gear pump further comprises: a second pump cover disposed at a proximal side of the pump ring gear and comprising one or more respective cross-holes and a respective pocket; and a second bushing disposed about the pump shaft at the proximal side of the pump ring gear, wherein an exterior surface of the second bushing interfaces with an interior surface of the second pump cover, wherein the respective pocket is formed about a portion of the second bushing, wherein the one or more respective cross-holes of the pump cover are configured to fluidly couple the outlet chamber to the respective pocket, thereby causing fluid in the respective pocket to apply a respective supporting force to the pump shaft.

EEE 7 is the gear pump of any of EEEs 1-6, further comprising: a drain port isolated from the inlet chamber and disposed downstream from the pocket, such that fluid that has applied the supporting force on the pump shaft flows to the drain port.

EEE 8 is the gear pump of EEE 7, further comprising: an end cover coupled to the pump cover, wherein the drain port is formed in the end cover.

EEE 9 is a method comprising: rotating a pump shaft of a gear pump, wherein a pump pinion is mounted to the pump shaft and disposed within a pump ring gear of the gear pump, such that external teeth of the pump pinion engage with internal teeth of the pump ring gear, and wherein rotating the pump shaft rotates the pump pinion, thereby rotating the pump ring gear engaged therewith to displace fluid from an inlet chamber to an outlet chamber of the gear pump: providing fluid from the outlet chamber to a pocket formed about a portion of a bushing disposed about the pump shaft: applying a supporting force to the pump shaft by fluid in the pocket; and draining fluid that has applied the supporting force to a drain port that is isolated from the inlet chamber.

EEE 10 is the method of EEE 9, wherein the gear pump further comprises a pump cover, wherein the pump cover comprises the pocket and comprises one or more cross-holes fluidly coupling the outlet chamber to the pocket, and wherein providing fluid from the outlet chamber to the pocket comprises: communicating fluid from the outlet chamber via the one or more cross-holes to the pocket.

EEE 11 is the method of EEE 10, wherein the one or more cross-holes comprise: (i) a first cross-hole fluidly-coupled to the outlet chamber, (ii) a second cross-hole fluidly-coupled to the first cross-hole, and (iii) a third cross-hole fluidly coupling the second cross-hole to the pocket, and wherein communicating fluid from the outlet chamber via the one or more cross-holes to the pocket comprises: communicating fluid from the outlet chamber via the first cross-hole to the second cross-hole; communicating fluid from the second cross-hole to the third cross-hole; and communicating fluid from the third cross-hole to the pocket.

EEE 12 is the method of EEE 11, wherein the gear pump further comprises a thrust plate interposed axially between the pump cover and the pump ring gear, wherein the thrust plate comprises a through-hole fluidly-coupled to the outlet chamber, and wherein the pump cover comprises a blind hole receiving fluid from the through-hole of the thrust plate and fluidly-coupled to the first cross-hole of the pump cover, and wherein communicating fluid from the outlet chamber via the first cross-hole comprises: communicating fluid from the outlet chamber through the through-hole of the thrust plate to the blind hole; and communicating fluid from the blind hole via the first cross-hole to the second cross-hole.

EEE 13 is the method of any of EEEs 9-12, wherein the bushing has a cross-hole fluidly-coupled to the pocket, and wherein the method further comprises: communicating fluid from the pocket via the cross-hole of the bushing to within the bushing at an interface between an exterior surface of the pump shaft and an interior surface of the bushing, thereby causing the fluid to apply the supporting force to the pump shaft.

EEE 14 is the method of any of EEEs 9-13, wherein the bushing is a first bushing disposed at a distal side of the pump ring gear, and wherein the gear pump further comprises a second bushing disposed about the pump shaft at a proximal side of the pump ring gear, and wherein the method further comprises: providing fluid from the outlet chamber to a respective pocket formed about a portion of the second bushing, thereby causing fluid in the respective pocket to apply a respective supporting force to the pump shaft.

EEE 15 is the method of EEE 9, wherein the gear pump further comprises an end cover, wherein the drain port is formed in the end cover, and wherein draining fluid that has applied the supporting force to the drain port comprises: communicating fluid that has applied the supporting force to a chamber formed within the end cover, wherein the chamber is fluidly-coupled to the drain port.

What is claimed is:

1. A gear pump comprising:

a pump ring gear;

a pump shaft;

a pump pinion mounted to the pump shaft and disposed within the pump ring gear, such that external teeth of the pump pinion engage with internal teeth of the pump ring gear, wherein the pump shaft is configured to rotate the pump pinion, thereby rotating the pump ring gear engaged therewith to displace fluid from an inlet chamber to an outlet chamber of the gear pump;

a pump cover comprising one or more cross-holes and a pocket;

a bushing disposed about the pump shaft, wherein an exterior surface of the bushing interfaces with an interior surface of the pump cover, wherein the pocket is formed underneath the bushing interfacing with the interior surface of the pump cover, wherein the one or more cross-holes of the pump cover fluidly couple the outlet chamber to the pocket, thereby causing fluid in the pocket to apply a supporting force to the pump shaft;

a drain port isolated from the inlet chamber, wherein the drain port is disposed downstream from, and is fluidly coupled to the pocket, such that fluid from the pocket that has applied the supporting force on the pump shaft flows to the drain port; and an end cover coupled to the pump cover, wherein the drain port is disposed in the end cover axially aligned with the pump shaft.

2. The gear pump of claim 1, wherein the bushing has a cross-hole fluidly-coupled to the pocket and configured to communicate fluid from the pocket to within the bushing at an interface between an exterior surface of the pump shaft and an interior surface of the bushing, thereby causing the fluid to apply the supporting force to the pump shaft.

3. The gear pump of claim 1, wherein the bushing is a first bushing disposed at a distal side of the pump ring gear, and wherein the pump cover is a first pump cover disposed at the distal side of the pump ring gear, and wherein the gear pump further comprises:

a second pump cover disposed at a proximal side of the pump ring gear and comprising one or more respective cross-holes and a respective pocket; and a second bushing disposed about the pump shaft at the proximal side of the pump ring gear, wherein an exterior surface of the second bushing interfaces with an interior surface of the second pump cover, wherein the respective pocket is formed about a portion of the second bushing, wherein the one or more respective cross-holes of the pump cover are configured to fluidly couple the outlet chamber to the respective pocket, thereby causing fluid in the respective pocket to apply a respective supporting force to the pump shaft.

4. The gear pump of claim 1, wherein pressure level at the drain port is higher than pressure level in the inlet chamber.

5. The gear pump of claim 1, wherein a pressure drop between fluid provided to the pocket and the drain port is smaller compared to a respective pressure drop between the fluid provided to the pocket and the inlet chamber.

6. A gear pump comprising:

a pump ring gear;

a pump shaft;

a pump pinion mounted to the pump shaft and disposed within the pump ring gear, such that external teeth of the pump pinion engage with internal teeth of the pump ring gear, wherein the pump shaft is configured to rotate the pump pinion, thereby rotating the pump ring gear engaged therewith to displace fluid from an inlet chamber to an outlet chamber of the gear pump;

a pump cover comprising one or more cross-holes and a pocket;

a thrust plate interposed axially between the pump cover and the pump ring gear, wherein the thrust plate comprises a through-hole fluidly-coupled to the outlet chamber, and wherein the pump cover comprises a blind hole receiving fluid from the through-hole of the thrust plate, and wherein a cross-hole of the one or more cross-holes of the pump cover is fluidly-coupled to the blind hole, wherein the one or more cross-holes comprise:

a first cross-hole fluidly-coupled to the blind hole, a second cross-hole fluidly-coupled to the first cross-hole, and a third cross-hole fluidly coupling the second cross-hole to the pocket; and a bushing disposed about the pump shaft, wherein an exterior surface of the bushing interfaces with an interior surface of the pump cover, wherein the pocket is formed about a portion of the bushing, wherein the one or more cross-holes of the pump cover fluidly couple the outlet chamber to the pocket, thereby causing fluid in the pocket to apply a supporting force to the pump shaft.

7. A method comprising:

rotating a pump shaft of a gear pump, wherein a pump pinion is mounted to the pump shaft and disposed within a pump ring gear of the gear pump, such that external teeth of the pump pinion engage with internal teeth of the pump ring gear, and wherein rotating the pump shaft rotates the pump pinion, thereby rotating the pump ring gear engaged therewith to displace fluid from an inlet chamber to an outlet chamber of the gear pump, wherein the gear pump further comprises an end cover having a drain chamber formed therein;

providing fluid from the outlet chamber to a pocket formed about a portion of a bushing disposed about the pump shaft, wherein the bushing has a cross-hole fluidly-coupled to the pocket;

communicating fluid from the pocket via the cross-hole of the bushing to within the bushing at an interface between an exterior surface of the pump shaft and an interior surface of the bushing;

applying a supporting force to the pump shaft by fluid communicated from the pocket via the cross-hole;

communicating fluid that has applied the supporting force to the drain chamber formed in the end cover; and draining fluid from the drain chamber of the end cover to a drain port in the end cover, wherein the drain port is isolated from the inlet chamber.

8. The method of claim 7, wherein the gear pump further comprises a pump cover, wherein the pump cover comprises the pocket and comprises one or more cross-holes fluidly coupling the outlet chamber to the pocket, and wherein providing fluid from the outlet chamber to the pocket comprises:

communicating fluid from the outlet chamber via the one or more cross-holes to the pocket.

9. The method of claim 8, wherein the one or more cross-holes comprise: (i) a first cross-hole fluidly-coupled to the outlet chamber, (ii) a second cross-hole fluidly-coupled to the first cross-hole, and (iii) a third cross-hole fluidly coupling the second cross-hole to the pocket, and wherein communicating fluid from the outlet chamber via the one or more cross-holes to the pocket comprises:

communicating fluid from the outlet chamber via the first cross-hole to the second cross-hole;

communicating fluid from the second cross-hole to the third cross-hole; and communicating fluid from the third cross-hole to the pocket.

10. The method of claim 9, wherein the gear pump further comprises a thrust plate interposed axially between the pump cover and the pump ring gear, wherein the thrust plate comprises a through-hole fluidly-coupled to the outlet chamber, and wherein the pump cover comprises a blind hole receiving fluid from with the through-hole of the thrust plate and fluidly-coupled to the first cross-hole of the pump cover, and wherein communicating fluid from the outlet chamber via the first cross-hole comprises:

communicating fluid from the outlet chamber through the through-hole of the thrust plate to the blind hole; and communicating fluid from the blind hole via the first cross-hole to the second cross-hole.

11. The method of claim 7, wherein the bushing is a first bushing disposed at a distal side of the pump ring gear, and wherein the gear pump further comprises a second bushing disposed about the pump shaft at a proximal side of the pump ring gear, and wherein the method further comprises:

providing fluid from the outlet chamber to a respective pocket formed about a portion of the second bushing, thereby causing fluid in the respective pocket to apply a respective supporting force to the pump shaft.

* * * * *